US012419433B1

(12) United States Patent
Grutta et al.

(10) Patent No.: US 12,419,433 B1
(45) Date of Patent: Sep. 23, 2025

(54) CUSHIONS WITH COLUMNS INCLUDING FIRMNESS-DEFINING FEATURES

(71) Applicant: Purple Innovation, LLC, Lehi, UT (US)

(72) Inventors: James Grutta, Draper, UT (US); Dhyey Yogesh Acharya, Lehi, UT (US); Jenan Ahmed Mostafa, Lehi, UT (US); Chris Campagnoni, Park City, UT (US); Cayden Ackley, Lehi, UT (US)

(73) Assignee: Purple Innovation, LLC, Lehi, UT (US)

( * ) Notice: Subject to any disclaimer, the term of this patent is extended or adjusted under 35 U.S.C. 154(b) by 0 days.

(21) Appl. No.: 18/957,109

(22) Filed: Nov. 22, 2024

(51) Int. Cl.
*A47C 27/00* (2006.01)
*A47C 27/08* (2006.01)

(52) U.S. Cl.
CPC ..... *A47C 27/00* (2013.01); *A47C 27/085* (2013.01); *A47C 27/08* (2013.01)

(58) Field of Classification Search
CPC ..... A47C 27/00; A47C 27/085; A47C 27/08; Y10S 5/909
USPC ..... 5/652, 654, 655.5, 909
See application file for complete search history.

(56) References Cited

U.S. PATENT DOCUMENTS 3,870,450 A * 3/1975 Graebe ..... A61G 7/05769 425/269
4,005,236 A * 1/1977 Graebe ..... B29D 22/02 428/72
4,541,136 A * 9/1985 Graebe ..... A47C 27/081 5/655.3
4,698,864 A * 10/1987 Graebe ..... A47C 27/10 297/DIG. 3
5,052,068 A * 10/1991 Graebe ..... A47C 27/10 297/452.41
5,163,196 A * 11/1992 Graebe ..... A61G 5/1043 5/944
5,749,111 A * 5/1998 Pearce ..... B29C 48/11 428/137
6,026,527 A * 2/2000 Pearce ..... B29C 48/08 428/137
6,413,458 B1 * 7/2002 Pearce ..... A47C 27/15 264/141
6,550,085 B2 * 4/2003 Roux ..... A47C 27/10 5/944
6,684,430 B2 * 2/2004 Roux ..... A47C 27/10 5/944
7,060,213 B2 * 6/2006 Pearce ..... B29C 44/583 264/331.13

(Continued)

FOREIGN PATENT DOCUMENTS

WO WO-9908571 A1 * 2/1999 ..... A43B 13/04

*Primary Examiner* — Robert G Santos
(74) *Attorney, Agent, or Firm* — Foley & Lardner LLP

(57) ABSTRACT

Systems and methods for a cushion with at least one firmness feature are provided. A cushion may include an array of interconnected columns, each column of the array of interconnected columns having a height extending through a thickness of the cushion. At least one column of the array of interconnected columns may include at least one wall defined from a compressible, resilient material; a void defined by the at least one wall and extending through the height of the at least one column; and a firmness-defining feature extending along a height of the at least one wall.

18 Claims, 7 Drawing Sheets

(56) References Cited

U.S. PATENT DOCUMENTS

| | | | | |
|---|---|---|---|---|
| 7,076,822 | B2 * | 7/2006 | Pearce | B29C 48/022 5/655.5 |
| 2002/0013967 | A1 * | 2/2002 | Roux | A47C 27/081 5/654 |
| 2003/0096899 | A1 * | 5/2003 | Pearce | C08K 5/0016 524/474 |
| 2003/0131417 | A1 * | 7/2003 | Roux | A47C 27/10 5/655.3 |
| 2004/0226098 | A1 * | 11/2004 | Pearce | B29C 44/50 264/141 |
| 2004/0226099 | A1 * | 11/2004 | Pearce | B29C 48/11 5/655.5 |
| 2004/0229986 | A1 * | 11/2004 | Pearce | C08L 51/006 525/271 |
| 2005/0017396 | A1 * | 1/2005 | Pearce | B29C 48/022 264/211.13 |
| 2006/0253988 | A1 * | 11/2006 | Pearce | B29C 48/11 5/655.5 |

* cited by examiner

CUSHIONS WITH COLUMNS INCLUDING FIRMNESS-DEFINING FEATURES

TECHNICAL FIELD

This disclosure relates generally to cushions and more specifically to cushions that include arrays of interconnected columns. Even more specifically, this disclosure relates to cushions with arrays of interconnected columns, with at least one of the columns of the array of interconnected columns including a firmness-defining feature extending along a height of a wall of the column. Methods for designing cushions are also disclosed.

BACKGROUND

Cushions with arrays of interconnected columns are typically made from dense elastomeric materials, which make the cushions-particularly mattresses including such cushions-heavy and, thus, cumbersome to ship and handle. The array of interconnected columns of such a cushion may define a grid, or a tessellated arrangement, of square or diamond shaped columns, which are intended to respond to applied forces, such as the weight of a human being. Generally, the formed cushions are heavy and utilize a lot of material, increasing costs of manufacturing and shipping the cushion.

SUMMARY

In one aspect, a cushion that includes an array of interconnected columns is disclosed. The heights of the columns of such a cushion extend through a thickness of the cushion, or between major surfaces (e.g., a top, a bottom, etc.) of the cushion. Each column includes at least one wall. The at least one wall defines a void of the cushion, which extends along the height of the column. Thus, the column comprises a hollow column. The void may extend through the entire height of the column.

In some embodiments, the column may have a configuration that enables it to buckle under a load, such as the weight of a portion of a body of a subject supported by the cushion. Such a column or, more specifically, the wall(s) that define(s) such a column, along with any optional walls that connect such a column to adjacent columns, may be formed from a compressible, resilient material. For example, a thermoplastic elastomer (TPE), such as a plasticizer-extended block copolymer (e.g., an A B-A block copolymer, such as a styrenic block copolymer (e.g., stryrene [ethylene-(ethylene-propylene)]-styrene (SEEPS) block copolymer), etc.) may be used to form the wall(s) that define(s) the column and any optional walls that connect the column to adjacent columns.

At least one wall of at least one column of the array of interconnected columns of the cushion may include a firmness-defining feature. In some embodiments, a column may include a plurality of firmness-defining features. In some embodiments, a position each of the plurality of firmness-defining features relative to another of the plurality of firmness-defining features is defined by a central angle. In some embodiments, the plurality of firmness-defining features comprises a first pair of firmness-defining features and a second pair of firmness-defining features, wherein a first central angle between a first firmness-defining feature of the first pair and a second firmness-defining feature of the second pair is less than a second central angle between the first pair and the second pair. In some embodiments, the firmness-defining feature is formed of the same material as the at least one wall. Each firmness-defining feature may extend along a height of the wall of the column. In some embodiments, each firmness-defining feature may extend along an entire height of the wall. Each firmness-defining feature may have a configuration that dictates a manner in which the column collapses (e.g., buckles, etc.) when placed under a load. For example, each firmness-defining feature may dictate a force under which the column collapses. Each firmness-defining feature may dictate a frequency and/or an amplitude of an energy pulse released by the column as it collapses, which may dictate whether or not a user of the cushion can feel the column buckle. Stated another way, each firmness-defining feature may define a perceptibility of the energy pulse released under the user's weight to the user of the cushion.

A firmness-defining feature may comprise a spine that protrudes from a surface of the wall of the column. Alternatively, a firmness-defining feature may comprise an indentation (e.g., a groove, a channel, etc.) formed in a surface of the wall of the column. A firmness-defining feature may be located on an outer surface of a column or on an inner surface of the column.

In another aspect, a cushion with one or more areas that are tailored to respond to a load placed upon them is disclosed. Such a cushion may include an array of interconnected columns, with a group of adjacent columns of the array of interconnected columns including firmness-defining features that cause the group of adjacent columns to respond differently to a load than other columns of the array of interconnected columns respond to the load. The group of adjacent columns may comprise a zone of the cushion. For example, a cushion may include a plurality of zones that extend across its width from one end of the cushion to an opposite end of the cushion (e.g., a mattress may include a head zone, one or more intermediate zones, and a foot zone, etc.). As another example a cushion may include a central zone, a peripheral zone, and, optionally, one or more intermediate zones between the central zone and the peripheral zone. Each zone of such a cushion may have a different stiffness or a respond to a load differently from at least one other zone of the cushion. The stiffness or responsiveness of the zone may be designed for a particular range of loads that are expected to be applied to it. By designing a cushion with different zones that respond to different loads in different ways, the cushion may be "tuned" in such a way as to provide a user with a desired perceptibility (e.g., no perceptibility, a minimized perceptibility, an intermediate perceptibility, a high perceptibility, etc.) of energy pulses released by the columns as they collapse.

Methods of designing and providing cushions to have desired stiffness profiles, to create local regions of extra support, and/or to have profiles that are tuned to respond to a load in a particular manner or to have a particular load-response (e.g., collapsing, buckling, etc.) behavior are also disclosed. One method includes configuring an array of interconnected columns, each column of the array of interconnected columns having a height extending through at least a portion of a thickness of the cushion; configuring each column of the array of interconnected columns to include at least one wall that is compressible and resilient, and a void defined by the at least one wall and extending through the height of the at least one column; and configuring at least one column of the array of interconnected columns to include a firmness-defining feature extending along a height of the at least one wall.

Other aspects of the disclosed subject matter, as well as features and advantages of various aspects of the disclosed subject matter should become apparent to those of ordinary skill in the art through consideration of the ensuing description, the accompanying drawings, and the appended claims.

Numerous specific details are provided to impart a thorough understanding of embodiments of the subject matter of the present disclosure. The described features of the subject matter of the present disclosure may be combined in any suitable manner in one or more embodiments and/or implementations. In this regard, one or more features of an aspect of the invention may be combined with one or more features of a different aspect of the invention. Moreover, additional features may be recognized in certain embodiments and/or implementations that may not be present in all embodiments or implementations.

DETAILED DESCRIPTION

Figure 1:
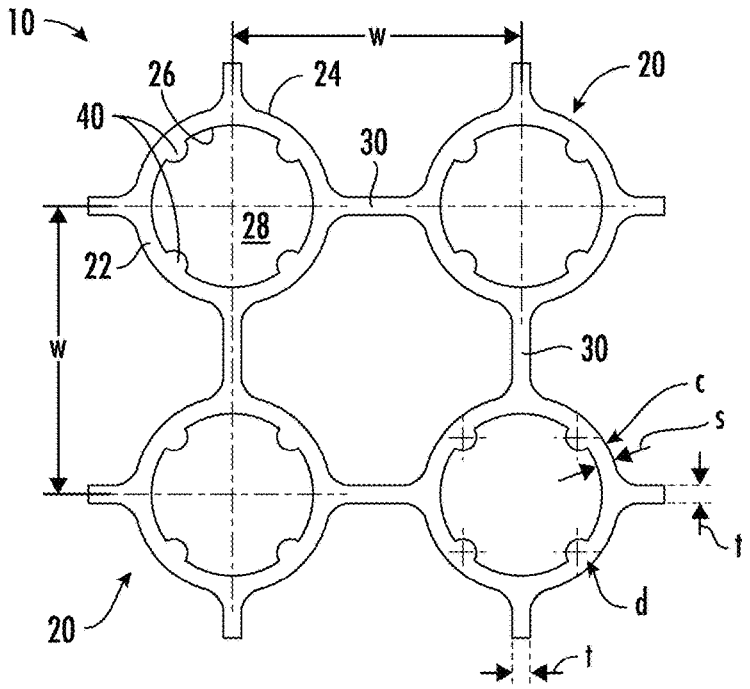
FIG. 1 is a plan view of a major surface of an embodiment of a portion of a cushion with an array of interconnected columns that include firmness-defining features that extend along a height of a wall of the column and protrude from an inner surface of the wall.

FIG. 1 shows an embodiment of a portion of a cushion 10. The cushion 10 includes an array of interconnected columns 20. Each column 20 includes at least one wall 22 with an outer surface 24 and an inner surface 26. The inner surface 26 defines a void 28, which extends along and through a height of the column 20. A diameter of the inner surface 26 may be defined by a diameter c of the outer surface 24 and a thickness s of the wall 22. In some embodiments, the diameter c may be 1.08-1.32 inch and the thickness s may be 0.101-0.124 inch. In some embodiments, the diameter c is 1.2 inches (30.48 mm). In some embodiments, the thickness s is 0.1125 inch (2.858 mm). Optionally, the cushion 10 may include connecting walls 30 of thickness t that extend laterally between adjacent columns 20 to connect the adjacent columns 20 to one another. The lateral distance between adjacent columns is defined by a distance w. In some embodiments, thickness t may be 0.09-0.11 inch and distance w may be 1.58-1.93 inches. In some embodiments, the thickness t is 0.1 inch (2.54 mm). In some embodiments, the distance w is 1.750 inches (44.45 mm).

Each column 20 includes at least one firmness-defining feature 40. As illustrated, each column 20 includes four firmness-defining features 40 positioned at equal or substantially equal distances around the inner surface 26 of the wall 22 of the column 20, although columns 20 that include any number and arrangement of firmness-defining features 40 are within the scope of this disclosure. Therefore, in some embodiments, at least one column 20 includes a plurality of firmness-defining features 40.

As illustrated, each firmness-defining feature 40 may protrude from the inner surface 26 of the wall 22. More specifically, each firmness-defining feature 40 may comprise an elongated spine that extends along a height of the wall 22 (e.g., along a portion of the height of the wall 22, along an entirety of the height of the wall 22, etc.). Each firmness-defining feature 40 may comprise a semicircular cylinder. In another embodiments, a different structure and/or shape firmness-defining features 40 may be implemented (e.g., square-shaped, etc.). A distance d across a cross-section of the firmness-defining feature 40 (shown in FIG. 1 as being a diameter of a circular cylinder centered on the inner surface 26 of the wall 22) may at least partially determine an extent to which the firmness-defining feature 40 increases a firmness of the column 20. In some embodiments, distance d may be 0.14-0.172 inch. In some embodiments, the distance d is 0.156 inch (3.962 mm).

The walls 22 of the columns 20, any optional connecting walls 30, and the firmness-defining features 40 of the cushion 10 may be formed from the same material. That material may be compressible and resilient, and it may comprise any suitable cushioning material. In another embodiment, at least one of the materials of walls 22 of the columns 20 and connecting walls 30 may differ from another of at least one of the materials of the walls 22 of the columns and walls 30. As an example, the material may comprise a thermoplastic elastomer (TPE). Without limitation, the thermoplastic elastomer may comprise a block copolymer (e.g., a triblock copolymer, such as an A-B-A triblock copolymer, etc.). The thermoplastic elastomer may be part of an elastomeric gel. The elastomeric gel may comprise a plasticizer-extended block copolymer. These plasticizer-extended block copolymers include plasticizer-extended A-B-A block copolymers, such as oil-extended styrene-[ethylene-(ethylene-propylene)]-styrene (SEEPS) block copolymers (see U.S. Pat. Nos. 5,994,450, 6,797,765, and 7,964,664, the entire disclosures of which are hereby incorporated herein), oil-extended styrene-(ethylene-butylene)-styrene (SEBS) block copolymers, and other oil extended A-B-A block copolymers. Alternatively, the walls 22, any optional connecting walls 30, and the firmness-defining features 40 may be formed from other materials, such as rubber (e.g., natural latex, polyurethane, silicone, butyl rubber, etc.), foam rubber (e.g., natural latex, polyurethane, viscoelastic foams, etc.), hydrogels, cross-linked polymers, or any other suitable material. Each column 20 may be identical to every other column 20 in the array of interconnected columns 20.

Figure 2:
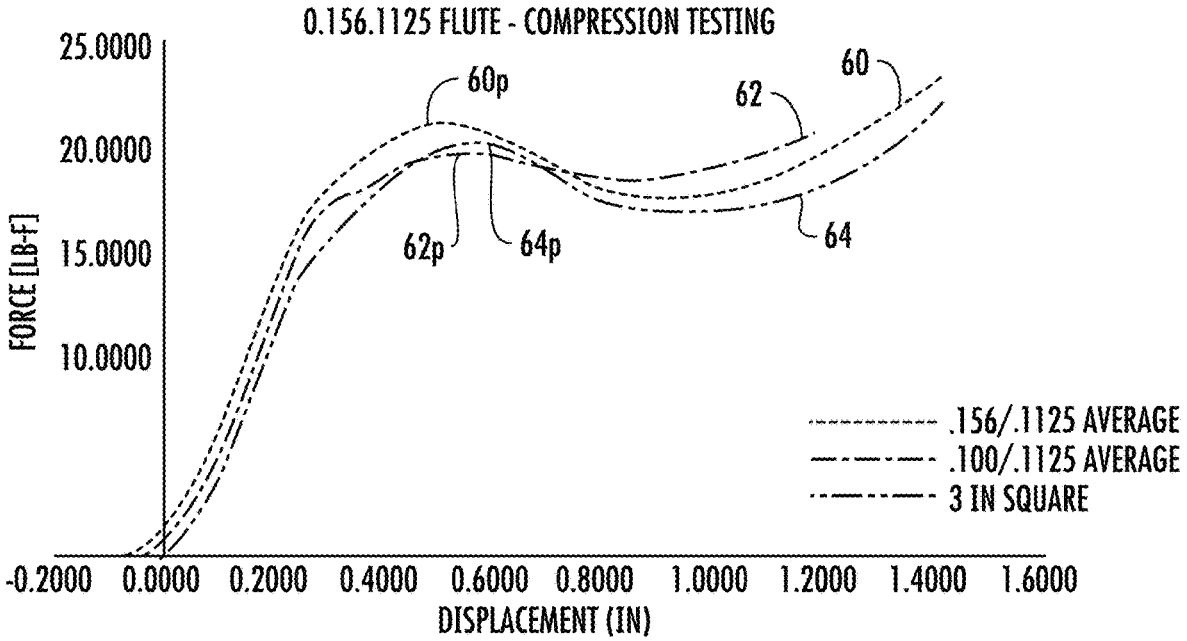
FIG. 2 is a graph showing the results of compression testing of the embodiment of the cushion shown in FIG. 1 to a similarly configured cushion without firmness-defining features and to conventional cushion with a square grid.

FIG. 2 is a graph showing a compression testing curve 60 for a 3 inch by 3 inch (7.6 cm by 7.6 cm) section of the cushion of FIG. 1, a compression testing curve 62 for a 3 inch by 3 inch (7.6 cm by 7.6 cm) section of a similarly configured cushion without firmness-defining features 40 (see U.S. patent application Ser. No. 18/528,273, titled ELASTOMERIC CUSHIONING ELEMENTS WITH SUBSTANTIALLY CYLINDRICAL COLUMNS, the entire disclosure of which is hereby incorporated herein), and a compression testing curve 64 for a 3 inch by 3 inch (7.6 cm by 7.6 cm) section of a cushion of the same thickness formed from the same material and having a square grid of the type currently found in mattresses sold by Purple Innovation, LLC of Lehi, Utah. Each curve 60, 62, 64 includes a peak 60*p*, 62*p*, 64*p* that represents the force (measured in lb-f) under which the wall or walls of each column (e.g., each column 20, etc.) of each cushion (e.g., cushion 10, etc.) collapse, or buckle, which is referred to as the "buckling point" of the column. As demonstrated by curve 60 and its peak 60*p*, the columns 20 of the cushion 10 of FIG. 1 are the stiffest; the greatest load is required to cause them to buckle. Curve 64 and its peak 64*p* show that the columns of the currently available cushion buckle under less force but greater displacement than the columns 20 of the cushion 10 of FIG. 1, while curve 62 and its peak 62*p* show that the columns of the cushion of the same configuration as FIG. 1 but no firmness-defining features 40 buckle under the least force, when displaced more than the columns 20 of the cushion 10 of FIG. 1. These results indicate that the firmness-defining features 40 have a measurable effect on the buckling point of a column 20 of a cushion 10 and suggest that variations in the firmness-defining features 40 (e.g., their dimensions, shapes, number, etc.) may enable tailoring of the buckling point of a column 20, as well as tailoring of other buckling behaviors of the column 20 (e.g., the extent to which the column is displaced before buckling occurs, the amount of energy released as the column 20 buckles, etc.).

Figure 3:
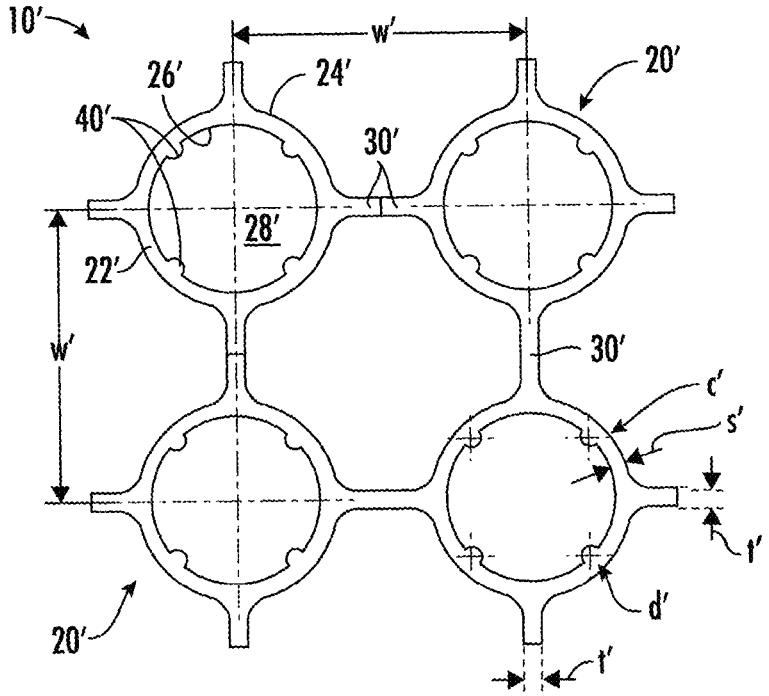
FIG. 3 is a plan view of a major surface of another embodiment of a portion of a cushion with an array of interconnected columns that include firmness-defining features that extend along a height of a wall of the column and protrude from an inner surface of the wall.

Turning now to FIG. 3, another embodiment of a cushion 10' is depicted. The cushion 10' includes an array of interconnected columns 20'. Each column 20' includes at least one wall 22' with an outer surface 24' and an inner surface 26'. The inner surface 26' defines a void 28', which extends along and through a height of the column 20'. A diameter of the inner surface 26' may be defined by a diameter c' of the outer surface 24' and a thickness s' of the wall 22'. In some embodiments, the diameter c' may be 1.08-1.32 inch and the thickness s' may be 0.09-0.11 inch. In some embodiments, the diameter c' is 1.2 inch (30.48 mm). In some embodiments, the thickness s' is 0.1 inch (2.54 mm). Optionally, the cushion 10' may include connecting walls 30' of thickness t' that extend laterally between adjacent columns 20' to connect the adjacent columns 20' to one another. The lateral distance between adjacent columns is defined by a distance w'. In some embodiments, thickness t' may be 0.09-0.11 inch and distance w' may be 1.58-1.93 inches. In some embodiments, the thickness t' is 0.1 inch (2.54 mm). In some embodiments, the distance w' is 1.750 inches (44.45 mm).

Each column 20' includes at least one firmness-defining feature 40'. As illustrated, each column 20' includes four firmness-defining features 40' positioned at equal distances around the inner surface 26' of the wall 22' of the column 20', although columns 20' that include any number and arrangement of firmness-defining features 40' are within the scope of this disclosure.

As illustrated, each firmness-defining feature 40' may protrude from the inner surface 26' of the wall 22'. More specifically, each firmness-defining feature 40' may comprise an elongated spine that extends along a height of the wall 22' (e.g., along a portion of the height of the wall 22', along an entirety of the height of the wall 22', etc.). Each firmness-defining feature 40' may comprise a semicircular cylinder. A distance d' across a cross-section of the firmness-defining feature 40' (depicted in FIG. 3 as being a diameter of a circular cylinder centered on the inner surface 26' of the wall 22') may at least partially determine an extent to which the firmness-defining feature 40' increases a firmness of the column 20'. In some embodiments, distance d' may be 0.113-0.138 inch. In some embodiments, the distance d' is 0.125 inches (3.175 mm). Since the firmness-defining features 40' of the columns 20' of the cushion 10' depicted by FIG. 3 are thinner than the firmness-defining features 40 of the columns 20 of the cushion 10 shown in FIG. 1, the embodiment of the cushion 10' depicted by FIG. 3, when made from the same material as the embodiment of the cushion 10 shown in FIG. 1, is expected to be softer (i.e., less firm) than the embodiment of the cushion 10 shown in FIG. 1.

The walls 22' of the columns 20', any optional connecting walls 30', and the firmness-defining features 40' may be formed from the same material. That material may be compressible and resilient, and it may comprise any suitable cushioning material; for example, any of the materials described in reference to the embodiment of the cushion 10 shown in FIG. 1. Each column 20' may be identical to every other column 20' in the array of interconnected columns 20'.

Figure 4:
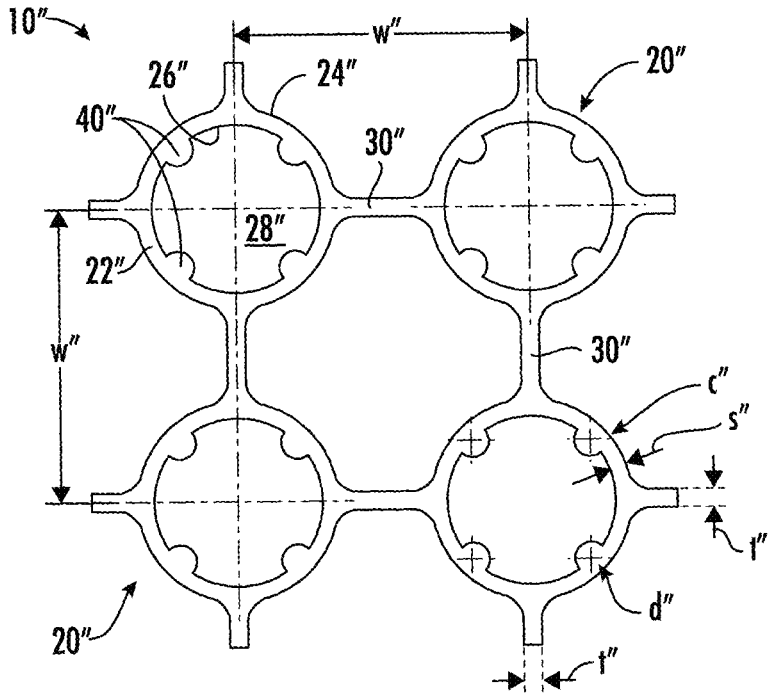
FIG. 4 is a plan view of a major surface of yet another embodiment of a portion of a cushion with an array of interconnected columns that include firmness-defining features that extend along a height of a wall of the column and protrude from an inner surface of the wall.

Referring to FIG. 4, another embodiment of a cushion 10" is illustrated. The cushion 10" includes an array of interconnected columns 20". Each column 20" includes at least one wall 22" with an outer surface 24" and an inner surface 26". The inner surface 26" defines a void 28", which extends along and through a height of the column 20". A diameter of the inner surface 26" may be defined by a diameter c" of the outer surface 24 and a thickness s" of the wall 22. In some embodiments, the diameter c" may be 1.08-1.32 inch and the thickness s" may be 0.09-0.11 inch. In some embodiments, the diameter c" is 1.2 inches (30.48 mm). In some embodiments, the thickness s" is 0.1 inch (2.54 mm). Optionally, the cushion 10" may include connecting walls 30" of thickness t" that extend laterally between adjacent columns 20" to connect the adjacent columns 20" to each other. The lateral distance between adjacent columns is defined by a distance w". In some embodiments, thickness t" may be 0.09-0.11 inch and distance w" may be 1.58-1.93 inches. In some embodiments, the thickness t" is 0.1 inch (2.54 mm). In some embodiments, the distance w" is 1.750 inches (44 mm).

Each column 20" includes at least one firmness-defining feature 40". As illustrated, each column 20" includes four firmness-defining features 40" positioned at equal or substantially equal distances around the outer surface 24" of the wall 22" of the column 20", although columns 20" that include any number and arrangement of firmness-defining features 40" are within the scope of this disclosure.

As illustrated, each firmness-defining feature 40" may protrude from the outer surface 24" of the wall 22". More specifically, each firmness-defining feature 40" may comprise an elongated spine that extends along a height of the wall 22" (e.g., along a portion of the height of the wall 22", along an entirety of the height of the wall 22", etc.). Each firmness-defining feature 40" may comprise a semicircular cylinder (although, in other embodiments and as with the other embodiments herein, a different shape may be utilized, such as square-shaped). A distance d" across a cross-section of the firmness-defining feature 40" (illustrated in FIG. 4 as being a diameter of a circular cylinder centered on the outer surface 24" of the wall 22") may at least partially determine an extent to which the firmness-defining feature 40" increases a firmness of the column 20". In some embodiments, distance d" may be 0.1688-0.2063 inch. In some embodiments, the distance d" is 0.1875 inch (4.763 mm). Since the firmness-defining features 40" of the columns 20" of the cushion 10" illustrated by FIG. 4 are thicker than the firmness-defining features 40 of the columns 20 of the cushion 10 shown in FIG. 1, the embodiment of the cushion 10" illustrated by FIG. 4, when made from the same material as the embodiment of the cushion 10 shown in FIG. 1, is expected to be firmer than the embodiment of the cushion 10 shown in FIG. 1.

The walls 22" of the columns 20", any optional connecting walls 30", and the firmness-defining features 40" may be formed from the same material (or, like the other embodiments described herein, at least one material may differ from another material of one of the elements). That material may be compressible and resilient, and it may comprise any suitable cushioning material; for example, any of the materials described in reference to the embodiment of the cushion 10 shown in FIG. 1. Each column 20 "may be identical to every other column 20" in the array of interconnected columns 20".

Figure 5:
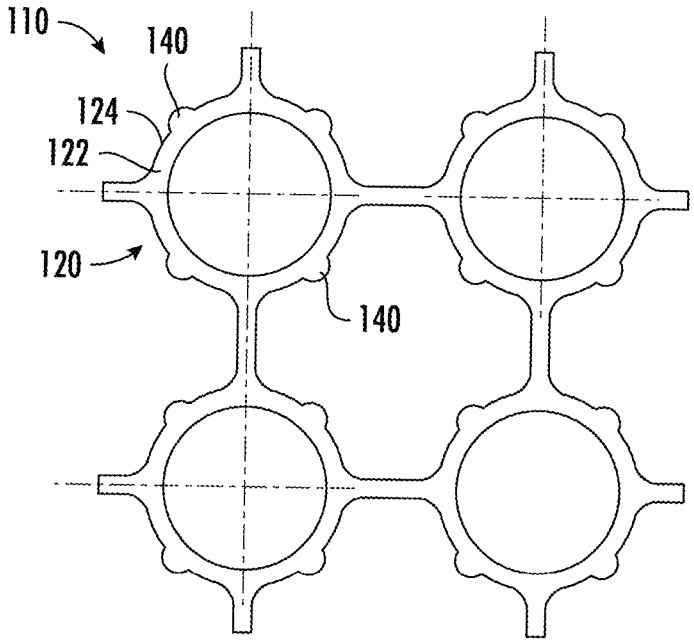
FIG. 5 is a plan view of a major surface of an embodiment of a portion of a cushion with an array of interconnected columns that include firmness-defining features that extend along a height of a wall of the column and protrude from an outer surface of the wall.
Figure 6:
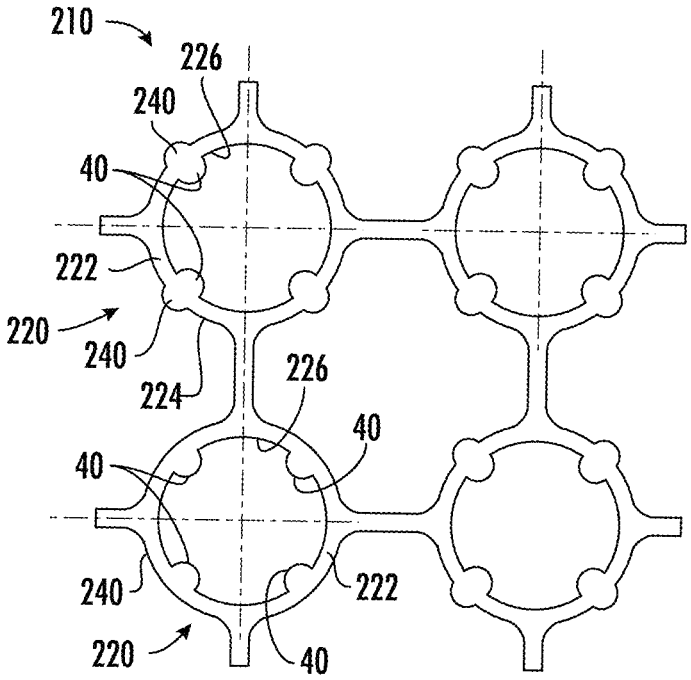
FIG. 6 is a plan view of a major surface of an embodiment of a portion of a cushion with an array of interconnected columns that include inner firmness-defining features that extend along a height of a wall of the column and protrude from an inner surface of the wall and outer firmness-defining features that extend along a height of a wall of the column and protrude from an outer surface of the wall.
Figure 7A:
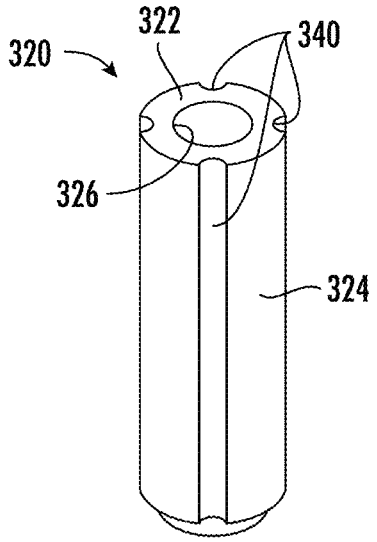
FIG. 7A is an orthogonal view of an embodiment of a column with firmness-defining features comprising indentations in a surface of a wall of the column and extending along the height of the wall.
Figure 7B:
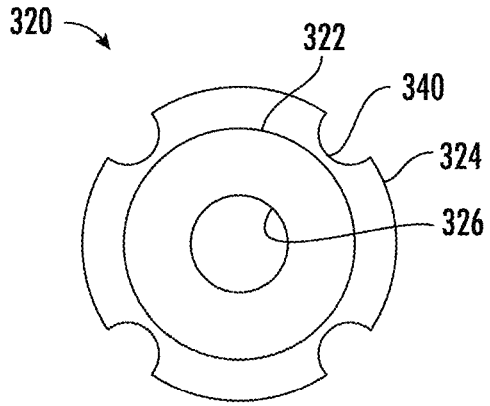
FIG. 7B is a plan view of an end of the column of FIG. 7A.
Figure 7C:
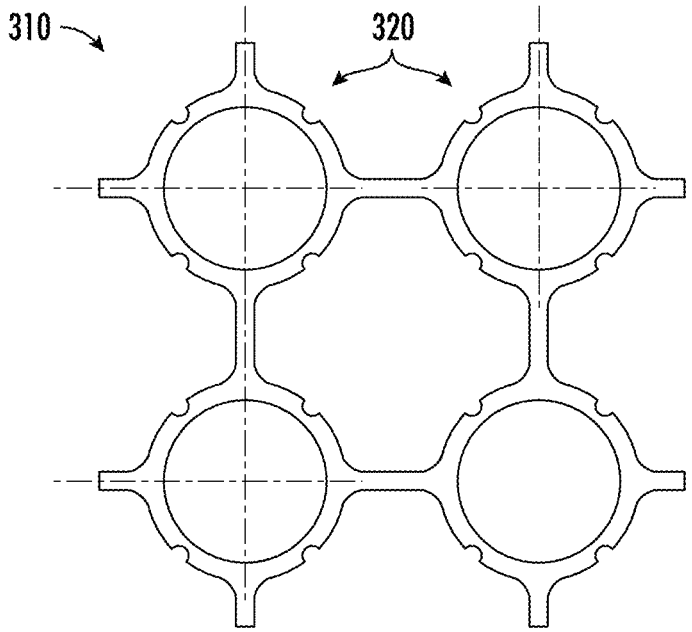
FIG. 7C is a plan view of a major surface of an embodiment of a portion of a cushion including an array of the columns of FIGS. 7A and 7B.

While FIGS. 1, 3, and 4 respectively show embodiments of cushions 10, 10', and 10" with firmness-defining features 40, 40', and 40" protruding from the inner surfaces 26, 26', and 26" of the walls 22, 22', and 22" of their columns 20, 20', and 20", FIG. 5 illustrates an embodiment of a cushion 110 with firmness-defining features 140 that protrude from the outer surfaces 124 of the walls 122 of its columns 120. FIG. 6 illustrates an embodiment of a cushion 210 that includes inner firmness-defining features 40 protruding from the inner surfaces 226 of the walls 222 of its columns 220 and outer firmness-defining features 240 protruding from the outer surfaces 224 of the walls 222 of its columns. In some embodiments, at least one column 220 of array of columns 220 in a cushion 210 is different from at least one other column 220 in the array of columns 220 in cushion 210. For example as shown in FIG. 6, one column 220 includes inner firmness defining features 40 protruding from an inner surface 224 of the walls 22 of the column 2200 and outer firmness-defining features 240 protruding from the outer surfaces 224 of the walls 222, and another column 220 includes only inner firmness-defining features 40, although columns 220 that include any number and arrangement and variation of firmness-defining features 40 additionally and/or alternatively with firmness-defining features 240 are within the scope of this disclosure FIGS. 7A and 7B depict another embodiment of a firmness-defining feature 340 for a column 320 of a cushion. Specifically, as shown in FIGS. 7A and 7B, a cushion may include at least one column 320 with a wall 322 that includes firmness-defining features 340 that are recessed into or comprise indentations in a surface of the wall 322; for example, in the outer surface 324, as depicted, the inner surface 326, or both the outer surface 324 and the inner surface 326. Each indentation may extend along a height of the wall 322 and, thus, comprise an elongated groove or channel in the surface of the wall 322. The size of each firmness-defining feature 340 (e.g., its radius, etc.) may correspond inversely to its effect on the firmness of the column 320, with larger firmness-defining features 340 making the column 320 softer (i.e., less firm) than smaller firmness-defining features 340. FIG. 7C depicts an embodiment of a cushion 310 that includes an array of interconnected columns 320. In some embodiments, each column 320 is identical to every other column 320 in the array of interconnected columns 320.

Figure 8:
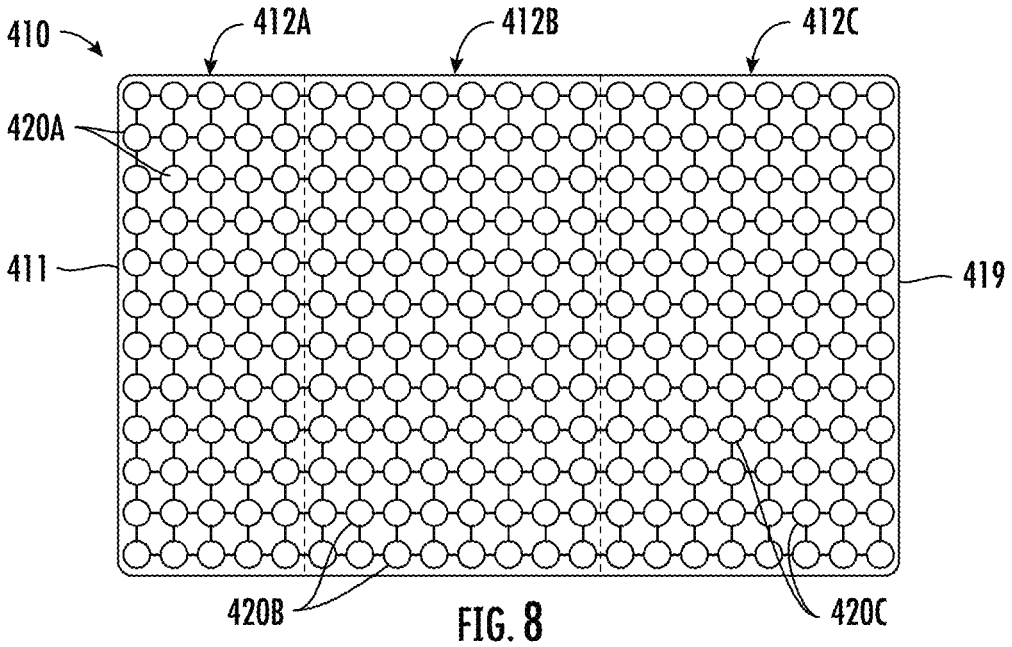
FIG. 8 is a schematic representation of an embodiment of a cushion with different zones of interconnected columns extending across a width of the cushion, from one end of the cushion to an opposite end of the cushion.

With reference to FIG. 8, an embodiment of a cushion 410 with a plurality of zones 412A, 412B, etc., is depicted. The zones 412A, 412B, etc. may be arranged along a first dimension of the cushion 410 (e.g., a length of a mattress or other cushion, etc.), from one end 411 of the cushion 410 (e.g., a head end of the mattress, etc.) to an opposite end 419 of the cushion 410 (e.g., a foot end of the mattress, etc.). Each zone 412A, 412B, etc., may extend across (e.g., partially, completely, etc.) a second dimension of the cushion 410 (e.g., a width of the mattress or other cushion, etc.).

Each zone 412A, 412B, etc., may include a plurality of columns 420A, 420B, etc., respectively. The columns 420A of one zone 412A may include flexibility-defining features 440A that differ (e.g., in size, in type, in shape, etc.) from the flexibility-defining features 440B of columns 420B in another zone 412B, etc., of the cushion 410. Thus, the firmness of the one zone 412A, the buckling points of the columns 420A of the one zone 412A, and/or other buckling characteristics (e.g., a frequency and/or an amplitude of energy pulses that occur during buckling, etc.) of the columns 420A of the one zone 412A may differ from the firmness, buckling points, and/or other buckling characteristics of the other zone 412B, etc., or its columns 420B. In some embodiments, the columns 420A of each zone 412A, 412B, etc. may be identical to each other. Thus, the firmness of the one zone 412A, the buckling points of the columns 420A of the one zone 412A, and/or other buckling characteristics (e.g., a frequency and/or an amplitude of energy pulses that occur during buckling, etc.) of the columns 420A of the one zone 412A may be identical to the firmness, buckling points, and/or other buckling characteristics of the other zone 412B, etc., or its columns 420B.

Figure 9:
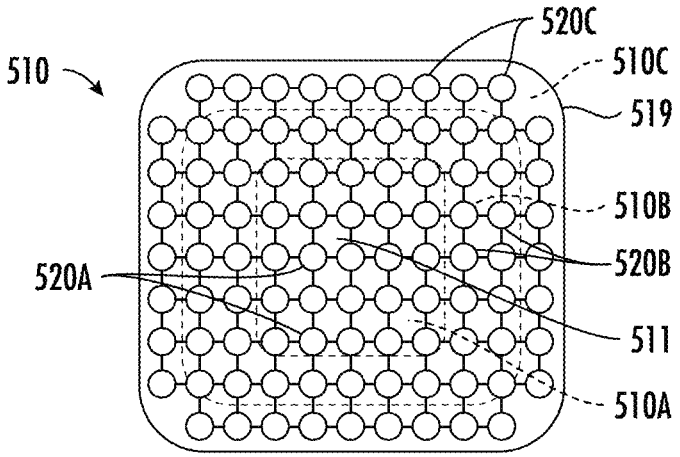
FIG. 9 is a schematic representation of another embodiment of a cushion of with different zones of interconnected columns arranged from a center of the cushion to a periphery of the cushion.

FIG. 9 depicts another embodiment of a cushion 510 with a plurality of zones 512A, 512B, etc. The zones 512A, 512B, etc. may be arranged somewhat concentrically, with one zone 512A being located somewhat centrally (i.e., at or near a center 511 of the cushion 510) and another zone 512B being located around the one zone 512A. The other zone 512B may be located adjacent to an outer periphery 519 of the cushion 510 or it may comprise an intermediate zone that is surrounded by yet another, even more peripherally located zone 512C. Such an arrangement of zone 512A, 512B, etc., may be useful for a seat cushion.

Each zone 512A, 512B, etc., may include a plurality of columns 520A, 520B, etc., respectively. The columns 520A of one zone 512A may include flexibility-defining features 540A that differ (e.g., in size, in type, in shape, etc.) from the flexibility-defining features 540B of another zone 512B, etc., of the cushion 510. Thus, the firmness of the one zone 512A, the buckling points of the columns 520A of the one zone 512A, and/or other buckling characteristics (e.g., a frequency and/or an amplitude of energy pulses that occur during buckling, etc.) of the columns 520A of the one zone 512A may differ from the firmness, buckling points, and/or other buckling characteristics of the other zone 512B, etc., or its columns 520B.

Figure 10:
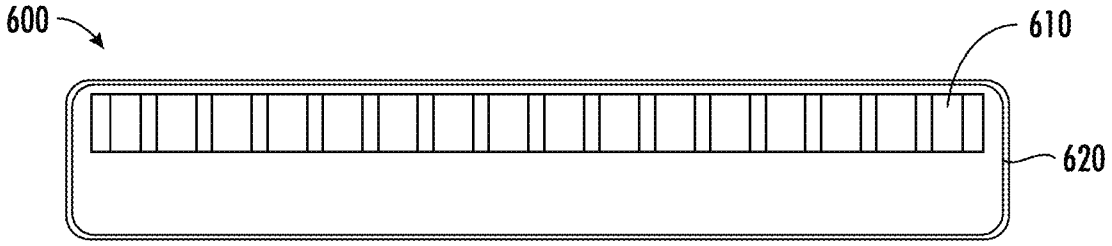
FIG. 10 is a schematic representation of a mattress that includes a cushion of this disclosure.

A cushion of this disclosure may be used in any of a variety of different contexts, including, without limitation, as part of a mattress, as discussed previously herein. Without limiting the scope of this disclosure, FIG. 10 shows an embodiment of a mattress 600 that includes a cushion 610 of this disclosure. The cushion 610 may comprise a primary cushioning element of the mattress 600. It may be included in the mattress 600 alone or with other components, such as a base, rails, coils, pressurizable elements, and the like. In addition, the cushion 610 and any optional internal components, the mattress 600 may include a cover 620 over the cushion 610 and the optional internal components. Other uses of a cushion of this disclosure are also contemplated and, thus, within the scope of this disclosure.

Figure 11:
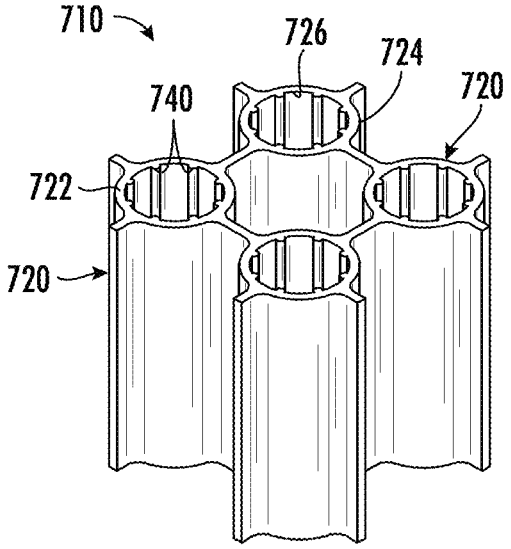
FIG. 11 is an orthogonal view of a portion of a cushion with an array of interconnected columns that include firmness-defining features that extend along a height of a wall of the column and protrude from an outer surface of the wall, according to an embodiment.

FIG. 11 depicts another embodiment of a firmness-defining feature 740 for a column 720 of a cushion, according to an example embodiment. Specifically, as shown in FIG. 11, a cushion may include at least one column 720 with a wall 722 that includes at least one firmness-defining feature 740 that protrudes from a surface of the wall 722; for example, in the outer surface 724, the inner surface 726, as depicted, or both the outer surface 724 and the inner surface 726. Each firmness-defining feature 740 may comprise an elongated spine that extends along or substantially along a height of the wall 722 (e.g., along a portion of the height of the wall 722, along an entirety of the height of the wall 722, etc.). Each firmness-defining feature 740 may comprise a semicircular cylinder. Alternatively and similar to the other embodiments herein, the shape and structure of the firmness-defining feature 740 may differ (e.g., square-shaped). In still other embodiments, a shape of one or more firmness-defining features 740 may differ from a shape of one or more other firmness-defining features (e.g., a semi-circular shaped firmness feature 740 and a square-shaped firmness feature). Further, some embodiments may include the firmness-defining feature on both the inner and outer surfaces, 726 and 724 respectively, and the shape of at least one firmness feature differs from another firmness-defining feature. A distance across a cross-section of the firmness-defining feature 740 (depicted in FIG. 13 as being a diameter of a circular cylinder centered on the inner surface 726 of the wall 722) may at least partially determine an extent to which the firmness-defining feature 740 increases a firmness of the column 720.

Figure 12:
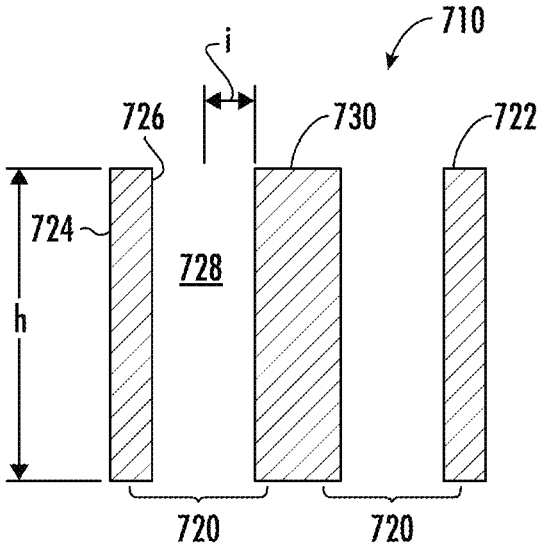
FIG. 12 is a cross sectional view of a portion of a cushion within an array of interconnected columns of FIG. 11.

FIG. 12 depicts a cross-sectional view of a portion of a cushion 710 within an array of interconnected columns 720, according to an exemplary embodiment of FIG. 11. Each column 720 includes at least one wall 722 with an outer surface 724 and an inner surface 726. The inner surface 726 defines a void 728. Column 720 is defined by a height h. In the illustrated embodiment, height h may be 2.646-3.234 inches. In some embodiments, the height h is 2.940 inches (74.68 mm). Optionally, the cushion 710 may include connecting walls 730 that extend laterally between adjacent columns 720 to connect the adjacent columns 720 to one another. Additionally, in some embodiments, the inner surface 726 may have a draft angle i determined by an injection mold process. Draft angle i may be between half of one degree and three degrees. In some embodiments, the draft angle i is one degree.

Figure 13:
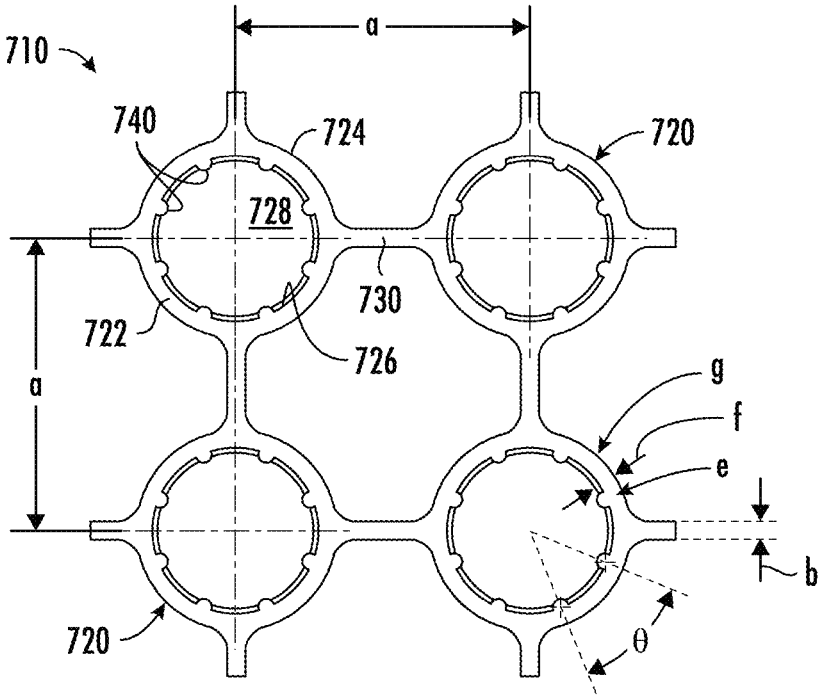
FIG. 13 is a plan view of a major surface of a portion of a cushion including an array of the columns of FIGS. 11 and 12.

Turning now to FIG. 13, the cushion 710 is shown including an array of interconnected columns 720, according to an exemplary embodiment of FIGS. 11 and 12. Each column 720 includes at least one wall 722 with an outer surface 724 and an inner surface 726. The inner surface 726 defines a void 728, which extends along and through a height of the column 720. A diameter of the inner surface 726 may be defined by a diameter g of the outer surface 724 and a thickness f of the wall 722. In some embodiments, the diameter g may be 1.08-1.32 inch and the thickness f may be 0.0936-0.1144 inch. In some embodiments, the diameter g may be 1.2 inches (30.38 mm). In some embodiments, the thickness f is 0.0104 inches (2.64 mm). It should be understood that these dimensions are exemplary only. In other embodiments, the dimensions may differ. Optionally, the cushion 710 may include connecting walls 730 of thickness b that extend laterally between adjacent columns 720 to connect the adjacent columns 720 to one another. The lateral distance between adjacent columns is defined by a distance a. In some embodiments, thickness b may be 0.09-0.11 inch and distance a may be 1.58-1.93 inches. In some embodiments, the thickness b is 0.1 inch (2.54 mm). In some embodiments, the distance a is 1.750 inches (44.45 mm). Each column 720 includes at least one firmness-defining feature 740. As illustrated, each column 720 includes eight firmness-defining features 740 positioned at equal or substantially equal distances around the inner surface 726 of the wall 722 of the column 720, although columns 720 that include any number and arrangement of firmness-defining features 740 are within the scope of this disclosure.

Figure 14:
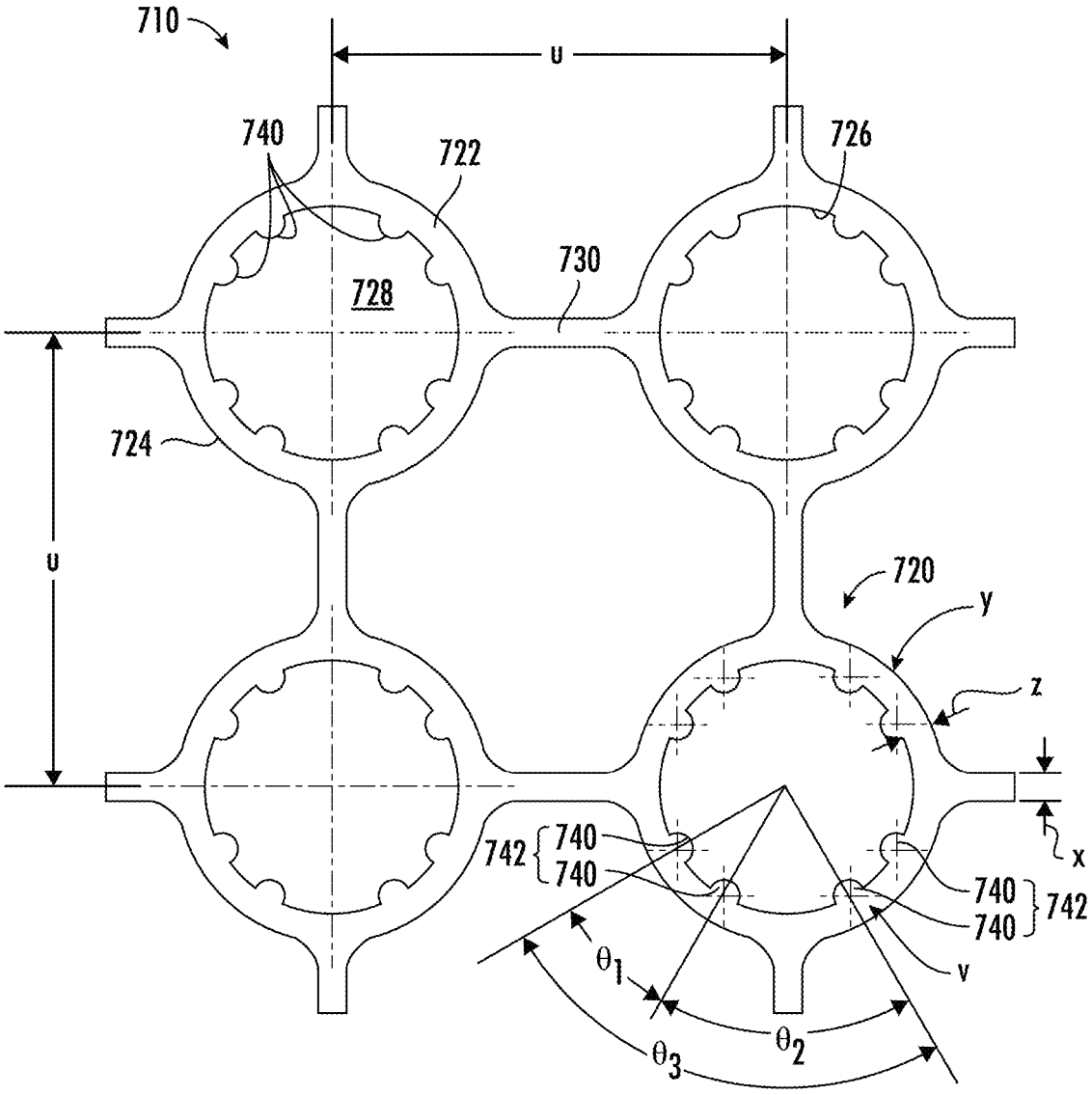
FIG. 14 is an orthogonal view of a portion of a cushion with an array of interconnected columns that include firmness-defining features that extend along a wall of the column and protrude from an outer surface of the wall, according to an embodiment.

The positions of two firmness-defining features 740 may be further defined by a central angle θ. The central angle θ thus describes the position of a first firmness-defining feature 740 relative to another firmness-defining feature 740. In some embodiments, the central angles θ between adjacent firmness-defining features 740 may have the same value or substantially similar value. In other embodiments, the central angles between adjacent firmness-defining features 740 may vary in value. As illustrated in FIG. 13, the central angles θ between all the adjacent firmness-defining features 740 are 45 degrees or approximately 45 degrees. As illustrated in FIG. 14, the firmness-defining features 740 are grouped into pairs 742, where the central angles between the firmness-defining features 740 within a pair 742 are $\theta_1$ and the central angles between adjacent firmness-defining features 740 in different pairs 742 are $\theta_2$. In some embodiments, central angles $\theta_1$ may be 27-33 degrees and central angles $\theta_2$ may be 54-66 degrees. In some embodiments, central angles $\theta_1$ are approximately 30 degrees and central angles $\theta_2$ are approximately 60 degrees.

As illustrated, each firmness-defining feature 740 may protrude from the inner surface 726 of the wall 722. More specifically, each firmness-defining feature 740 may comprise an elongated spine that extends along a height of the wall 722 (e.g., along a portion of the height of the wall 722, along an entirety of the height of the wall 722, etc.). Each firmness-defining feature 740 may comprise a semicircular cylinder. But, as mentioned above, different structural shapes may be implemented in other embodiments (e.g., a channel-shape, a protruding square shape, a triangular shape, etc.). A distance e across a cross-section of the firmness-defining feature 740 (illustrated in FIG. 13 as being a diameter of a circular cylinder centered on the outer surface 724 of the wall 722) may at least partially determine an extent to which the firmness-defining feature 740 increases a firmness of the column 720. In some embodiments, distance e may be 0.0963-0.1177 inch. In some embodiments, the distance e is 0.107 inches (2.718 mm). Since the firmness-defining features 740 of the columns 720 of the cushion 710 depicted by FIG. 13 are thinner than the firmness-defining features 40 of the columns 20 of the cushion 10 shown in FIG. 1, the embodiment of the cushion 710 depicted by FIG. 13, when made from the same material as the embodiment of the cushion 10 shown in FIG. 1, is expected to be softer (i.e., less firm) than the embodiment of the cushion 10 shown in FIG. 1.

The walls 722 of the columns 720, any optional connecting walls 730, and the firmness-defining features 740 may be formed from the same material. That material may be compressible and resilient, and it may comprise any suitable cushioning material; for example, any of the materials described in reference to the embodiment of the cushion 10 shown in FIG. 1. In some embodiments, each column 720 is identical to every other column 720 in the array of interconnected columns 720.

FIG. 14, the cushion 710 is shown including an array of interconnected columns 720, according to an exemplary embodiment of FIG. 13. Specifically, as shown in FIG. 14, a cushion 710 may include at least one column 720 with at least one wall 722 with an outer surface 724 and an inner surface 726. The inner surface 726 defines a void 728, which extends along and through a height of the column 720. A diameter of the inner surface 726 may be defined by a diameter y of the outer surface 724 and a thickness z of the wall 722. In some embodiments, the diameter y may be 1.08-1.32 inch and the thickness z may be 0.1013-0.1238 inch. In some embodiments, the diameter y may be 1.2 inches (30.48 mm). In some embodiments, the thickness z may be 0.1 inch (2.54 mm). Optionally, the cushion 710 may include connecting walls 730 of thickness x that extend laterally between adjacent columns 720 to connect the adjacent columns 720 to one another. The lateral distance between adjacent columns is defined by a distance u. In some embodiments, thickness x may be 0.09-0.11 inch and distance u may be 1.58-1.93 inches. In some embodiments, the thickness x is 0.1 inch (2.54 mm). In some embodiments, the distance u is 1.750 inches (44.45 mm).

Each column 720 includes at least one firmness-defining feature 740. Each firmness-defining feature 740 may comprise an elongated spine that extends along or substantially along a height of the wall. Each firmness-defining feature 740 may comprise a semicircular cylinder. As illustrated, each column 720 includes eight firmness-defining features 740 grouped into pairs 742, with each pair 742 positioned at equal or substantially equal distances around the inner surface 726 of the wall 722 of the column 720, although columns 720 that include any number and arrangement of firmness-defining features 740 are within the scope of this disclosure. A distance v across a cross-section of the firmness-defining feature 740 (illustrated in FIG. 14 as being a diameter of a circular cylinder centered on the outer surface 724 of the wall 722) may at least partially determine an extent to which the firmness-defining feature 740 increases a firmness of the column 720. In some embodiments, distance v may be 0.1107-0.1353 inch. In some embodiments, the distance v is 0.123 inch (3.124 mm).

As illustrated in FIG. 14, some central angles of adjacent firmness-defining features 740 are different than other central angles of adjacent firmness-defining features 740. The positions of two firmness-defining features 740 within a pair 742 may be further defined by a central angle $\theta_1$. The positions of firmness-defining features 740 between pairs 742 of firmness-defining features 740 may be further defined by a central angle $\theta_2$. The central angle $\theta_1$ between firmness-defining features 740 in the same pair 742 is different than the central angle $\theta_2$ between adjacent firmness-defining features 740 in different pairs 742. In some embodiments, central angles $\theta_1$ may be 27-33 degrees and central angles $\theta_2$ may be 54-66 degrees. The central angle $\theta_3$ from a point in a pair 742 and the corresponding point in an adjacent pair 742 is therefore the sum of 01 and 02. In some embodiments, central angles $\theta_1$ are 30 degrees and central angles $\theta_2$ are 60 degrees. In some embodiments, the central angle $\theta_3$ is equal to 90 degrees. The relationships between 01, 02, and 03 can thus be described by the following statements:

$$\theta_1<\theta_2<\theta_3 \quad (1)$$

$$\theta_1+\theta_2=\theta_3 \quad (2)$$

For a comparative example, in FIG. 13, the central angles of the adjacent firmness-defining features 740 are the same value, defining equal spacing of the adjacent firmness-defining features 740 along the inner surface 726. In FIG. 14, the central angles of adjacent firmness-defining features 740 vary, defining different spacing of the adjacent firmness-defining features 740 along the inner surface 726.

With returned reference to FIG. 1, a method for designing and/or providing a cushion 10 includes configuring an array of interconnected columns 20. The method also includes configuring at least one column 20 of the array of interconnected columns 20 to include at least one wall 22 that is compressible and resilient and a void 28 defined by an inner surface 26 of the at least one wall. The method further includes configuring the at least one column 20 to include at least one firmness-defining feature 40 extending along a height of the at least one wall 22. Optionally, such a method may also include configuring connecting walls 30 to extend between adjacent columns 20.

The act of configuring the firmness-defining feature(s) 40 of a column 20 may include configuring the firmness-defining feature(s) 40 to protrude from at least one surface (e.g. the inner surface 26, an outer surface 24, etc.) of the wall 22, as shown in FIG. 1. Briefly referring to FIGS. 7A and 7B, the act of configuring the firmness-defining feature(s) 340 may include configuring the firmness-defining feature(s) 340 as elongated recesses within one or both surfaces (e.g., the inner surface 326, the outer surface 324) of the wall(s) 322 of one or more columns 320.

With returned reference to FIG. 1, the act of configuring the firmness-defining feature(s) 40 may include configuring the firmness-defining feature(s) 40 to define a buckling behavior of the column 20 of which it is (they are) a part. The act of configuring the firmness-defining feature(s) 40 may comprises configuring the firmness-defining feature(s) 40 to define a frequency and/or an amplitude of an energy pulse released by the column 20 of which it is (they are) a part buckles. The act of configuring the firmness-defining feature(s) to define the frequency and/or the amplitude of the energy pulse may comprise tailoring a perceptibility of the energy pulse to a user of the cushion 10. The act of configuring the firmness-defining feature(s) to define the frequency and/or the amplitude of the energy pulse may comprise tailoring a central angle between adjacent firmness-defining feature(s). The act of configuring the firmness-defining feature(s) to define the frequency and/or the amplitude of the energy pulse may comprise tailoring a plurality of central angles including a central angle defining the angle between each firmness-defining feature(s) for each pair of firmness-defining features in the cushion 10.

The act of configuring at least one column 20 to include the firmness-defining feature(s) 40 may include configuring a group of columns 20 to include firmness-defining features 40. The firmness-defining features 40 may be the same in one zone of the cushion 10, but vary from zone to zone, as described in reference to FIGS. 8 and 9.

It should be understood that the aforementioned method may be appliable with the other cushion with firmness-defining feature embodiments shown and described herein.

Although the disclosure provides many specifics, the specifics should not be construed as limiting the scope of any of the claims, but merely as providing illustrations of some embodiments of elements and features of the disclosed subject matter that fall within the scopes of the claims. Other embodiments of the disclosed subject matter may be devised that are also within the scopes of the claims. Accordingly, the scope of each claim is limited only by its plain language and the legal equivalents thereto.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled" as used herein means the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References to "or" may be construed as inclusive so that any terms described using "or" may indicate any of a single, more than one, and all of the described terms. References to at least one of a conjunctive list of terms may be construed as an inclusive OR to indicate any of a single, more than one, and all of the described terms. For example, a reference to "at least one of 'A' and 'B'" can include only 'A', only 'B', as well as both 'A' and 'B'. Such references used in conjunction with "comprising" or other open terminology can include additional items.

References herein to the positions of elements (e.g., "top," "bottom," "above," "below," etc.) are merely used to describe the orientation of various elements in the FIGURES It should be noted that the orientation of various elements may differ according to other exemplary embodiments, and that such variations are intended to be encompassed by the present disclosure.

The construction and arrangement of the elements of the assembly as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present invention. For example, any element disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A cushion, comprising;

an array of interconnected columns, each column of the array of interconnected columns having a height extending through at least a portion of a thickness of the cushion, at least one column of the array of interconnected columns including:

at least one wall defined from a compressible, resilient material;

a void defined by the at least one wall and extending through the height of the at least one column; and a plurality of firmness-defining features, each of the plurality of firmness-defining features being structured as a spine protruding into the void from the at least one wall and extending uniformly along a height of the at least one wall.

2. The cushion of claim 1, wherein the spine protrudes from a surface of the at least one wall.

3. The cushion of claim 1, wherein the each of the plurality of firmness-defining features extends along an outer surface of the at least one wall.

4. The cushion of claim 1, wherein the each of the plurality of firmness-defining features extends along an inner surface of the at least one wall.

5. The cushion of claim 1, wherein the each of the plurality of firmness-defining features extends along an entire height of the at least one wall.

6. The cushion of claim 1, wherein the void extends through an entire height of the at least one column.

7. A cushion, comprising:

an array of interconnected columns, each column of the array of interconnected columns having a height extending through at least a portion of a thickness of a cushion, at least one column of the array of interconnected columns including:

at least one wall comprising a compressible, resilient material, the at least one wall comprising an inner surface and an outer surface opposite the inner surface; and a plurality of firmness-defining features, each of the plurality of firmness-defining features being structured as a spine protruding from the at least one wall and uniformly extending along the inner surface of the at least one wall, wherein the plurality of firmness-defining features are formed from the compressible, resilient material of the at least one wall.

8. The cushion of claim 7, wherein a position of each of the plurality of firmness-defining features relative to another of the plurality of firmness-defining features is defined by a central angle.

9. The cushion of claim 7, wherein the plurality of firmness-defining features comprises a first pair of firmness-defining features and a second pair of firmness-defining features, wherein a first central angle between a first firmness-defining feature of the first pair and a second firmness-defining feature of the first pair is less than a second central angle between the first pair and the second pair.

10. The cushion of claim 7, wherein the array of interconnected columns defines a plurality of zones, wherein at least one zone of the plurality of zones includes columns that differ from columns of another zone of the plurality of zones.

11. A method of providing a cushion, the method comprising:

configuring an array of interconnected columns, each column of the array of interconnected columns having a height extending through at least a portion of a thickness of the cushion;

configuring each column of the array of interconnected columns to include:

at least one wall that is compressible and resilient; and a void defined by the at least one wall and extending through the height of each column; and configuring at least one column of the array of interconnected columns to include:

a plurality of firmness-defining features, each of the plurality of firmness-defining features being structured as a spine protruding into the void from the at least one wall and extending uniformly along a height of the at least one wall of the at least one column.

12. The method of claim 11, wherein configuring the at least one column of the array of interconnected columns to include the plurality of firmness-defining features comprises configuring a group of columns of the array of interconnected columns to include the plurality of firmness-defining features.

13. The method of claim 11, wherein configuring the at least one column of the array of interconnected columns to include the plurality of firmness-defining features comprises configuring the plurality of firmness-defining features to define a buckling behavior of the at least one column.

14. The method of claim 13, wherein configuring the plurality of firmness-defining features comprises configuring the plurality of firmness-defining features to define a frequency and/or an amplitude of an energy pulse released by the at least one column as the at least one column buckles.

15. The method of claim 14, wherein configuring the plurality of firmness-defining features to define the frequency and/or the amplitude of the energy pulse comprises tailoring a perceptibility of the energy pulse to a user of the cushion.

16. The method of claim 14, wherein configuring the plurality of firmness-defining features to define the frequency and/or the amplitude of the energy pulse comprises tailoring a central angle between at least one pair of adjacent firmness defining features.

17. The method of claim 14, wherein the spine protrudes from a surface of the at least one wall.

18. The method of claim 14, wherein each of the plurality of firmness-defining features extends along an inner surface of the at least one wall of each column.

* * * * *